United States Patent [19]

Imanishi et al.

[11] Patent Number: 4,711,169

[45] Date of Patent: Dec. 8, 1987

[54] BALANCING DEVICE FOR PRESS

[75] Inventors: Shozo Imanishi; Mitsuo Sato, both of Sagamihara, Japan

[73] Assignee: Aida Engineering Co., Ltd., Kanagawa, Japan

[21] Appl. No.: 802,340

[22] Filed: Nov. 25, 1985

[51] Int. Cl.[4] ..... B30B 5/00

[52] U.S. Cl. ..... 100/257; 100/282; 72/446; 83/529

[58] Field of Search ..... 100/257, 282, 214; 83/527, 530, 525, 529; 72/446

[56] References Cited

U.S. PATENT DOCUMENTS

| | | | |
|---|---|---|---|
| 2,396,814 | 3/1946 | Besag | 83/529 |
| 2,784,665 | 3/1957 | Georgeff | 100/272 X |
| 3,115,086 | 12/1963 | Stimmel | 100/257 X |
| 3,400,625 | 9/1968 | Wrona | 100/257 X |
| 4,011,809 | 3/1977 | Waller | 100/257 X |

FOREIGN PATENT DOCUMENTS

| | | | |
|---|---|---|---|
| 33111 | 8/1972 | Japan | 100/257 |

*Primary Examiner*—Peter Feldman

*Attorney, Agent, or Firm*—Wenderoth, Lind & Ponack

[57] ABSTRACT

A balancing device for a press of the type in which a slide moves up and down with respect to a bolster, the balancing device having an upward urging device mounted on the press and engageable with the slide to urge the slide upwardly when the die height clearance is adjusted and to be disengageable from the slide when the slide is moving up and down during operation of the press.

5 Claims, 2 Drawing Figures

BALANCING DEVICE FOR PRESS

DETAILED DESCRIPTION OF THE INVENTION

1. Field of the Industrial Application

The present invention relates to a balancing device for a press.

2. Background and Problems of the Prior Art

In presses of the type in which a slide moves up and down with respect to a bolster, plural connections are generally provided between the slide and a crankshaft, with clearance at the connections being shifted to one side by the weight of the slide. Thus, when an operational load is applied by the press, the clearance shifts to the opposite side since the direction of the load is opposite to the direction of the weight, suspending the slide temporarily. To prevent this so-called "pausing" phenomenon and to ensure smooth slide motions, the conventional presses are usually equipped with slide balancers.

A slide balancer includes a balance cylinder which is fixed to a frame and has a piston rod, which is connected to the slide so that the slide can be energized upward by the balance cylinder to achieve the aforementioned function. The slide balancer is , however, deficient in its durability as it is constantly in operation along with the ascend/descend motions of the slide. Moreover, as the press collects speed during operation, the slide is also accelerated to an extent such that the balancer can no longer follow the motion and becomes incapable of the balancing function. Therefore, with high speed presses, the slide balancers may possibly be omitted.

On the other hand, the die height clearance is adjusted to accommodate changes in the height of the metal dies due to replacement, grinding, or modification thereof. Generally, a slide adjusting mechanism for die height adjustment comprises a screw shaft connected to a crankshaft by a connecting rod, a worm wheel rotatably supported by a slide and threaded to said screw shaft, a worm gear engaged with said worm wheel, and a motor to rotate said worm gear. If the slide balancer is omitted because of the presence of the above, die height adjustment becomes very difficult because the weight of the slide is directly applied on the slide adjusting mechanism.

As a countermeasure, use of a larger sized motor for the slide adjusting mechanism may be contemplated. However, because a motor of this type is generally carried on the slide, the weight of the slide will disadvantageously increase further.

OBJECT AND BRIEF SUMMARY OF THE INVENTION

Noting the fact that the balancing effect becomes unnecessary as the ascend/descend motions of the slide collect speed as mentioned above, the present invention seeks to provide a balancing device for presses which is capable of die height adjustment by a simple operation irrespective of the slide motions.

To achieve the object, the present invention proposes a means which is disconnected from the slide when the slide is in operation and which energizes the load of the slide upward during die height clearance adjustment.

More particularly, the press of the type in which a slide moves up and down relative to a bolster is characterized in that an energizing means which is disconnected from said slide when the slide is in ascend/descend motions and which energizes the same upward when the die height clearance is adjusted.

The present invention can provide a balancing device for presses which is free from problems otherwise caused by ascend/descend motions of the slide and which is capable of die height clearance adjustment with simple operation.

DETAILED DESCRIPTION OF THE INVENTION

Figure 1:
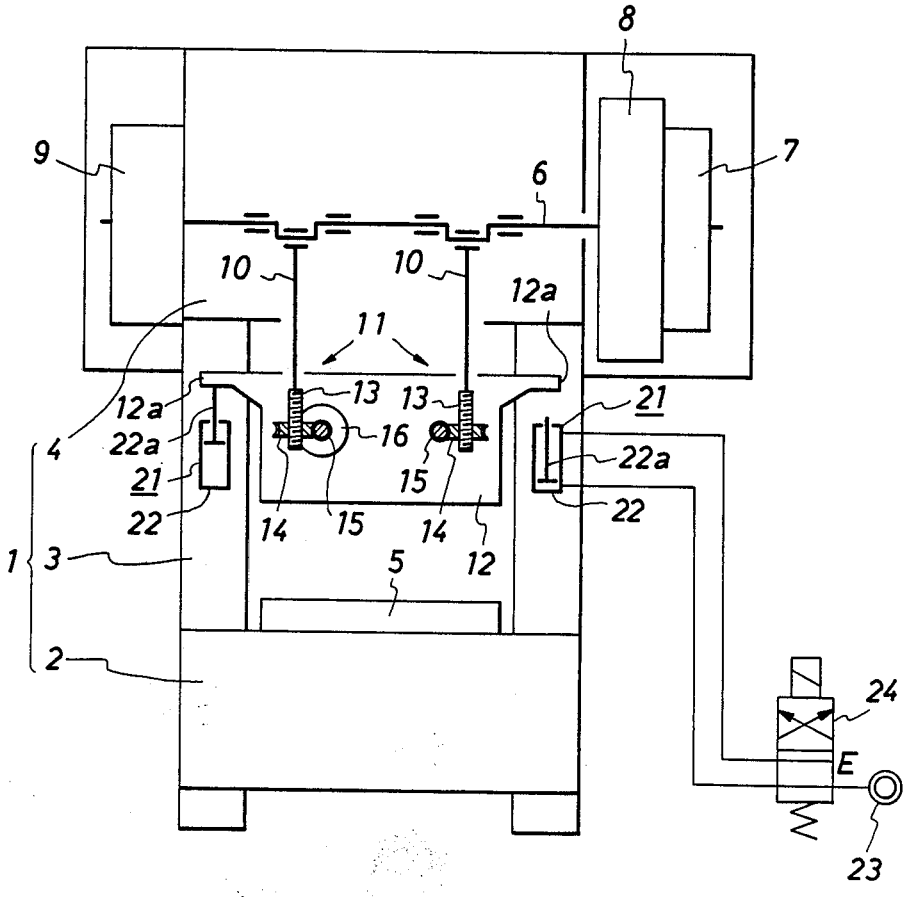
FIG. 1. is a schematic front view of a first embodiment of the press according to the present invention.

Referring to FIG. 1, a press frame 1 comprises a bed 2, columns 3 provided on both sides of said bed 2, and a crown 4 suspended between said columns 3 at their upper ends. A bolster 5 is provided on the upper surface of the bed 2 so that lower die (not shown) can be mounted thereon. Further, a crankshaft 6 is rotatably supported by said crown 4. On one end of the crankshaft 6 are provided a clutch 7 and a fly wheel 8 to transmit rotation from a motor (not shown) to the crankshaft 6. A brake 9 is provided on the other end thereof.

A slide 12 is provided in a manner to be freely movable upward and downward between the columns 3, the slide being connected to said crankshaft 6 via connecting rods 10 and slide adjusting means 11. An upward urging means 21 is provided on each of the columns 3 substantially at the center thereof to urge the slide 12 upward when the die height clearance is adjusted. At the lower surface of the slide 12, an upper die (not shown) is attached.

The slide adjusting means 11 each comprises a screw shaft 13 which is attached to the lower end of the connecting rod 10 respectively, a worm wheel 14 which is rotatably supported on the slide 12 but is not movable in the vertical direction and which is threaded on the corresponding screw shaft 13, a worm gear 15 which is engaged with the worm wheel 14, and a motor 16 which rotates the worm gear 15. As the motor 16 is driven, the worm wheels 14 are rotatingly displaced along the screw shafts 13 in the axial direction, whereby the height of the slide 12 is adjusted. The worm gears 15 are mechanically interlocked in the structure.

The upward urging means 21 each comprises a balance piston-cylinder device 22 which urges brackets **12*a* upward, the brackets projecting from both sides of the slide 12, a fluid pressure source 23 such as a compressor, and a 4-port electromagnetic switch valve 24 which selectively switches the supply of compressed air from the source 23 between an upper and a lower chambers of the balance piston-cylinder devices 22**.

The balance devices 22 are so positioned that the upper ends of respective piston rods **22*a* thereof will not interfere with the brackets 12*a* of the slide 12 when the compressed air from the fluid pressure source 23 is supplied to the respective upper chambers of the balance devices 22 by means of the 4-port electromagnetic switch valve 24, i.e. when the respective piston rods, 22*a* recede downward (see column on the right in FIG. 1). The balance cylinders 22 are so positioned that the upper ends of respective piston rods 22a will urge respective brackets 12a of the slide 12 upward from underneath when the compressed air supply from the fluid pressure source 23 is switched to the lower chambers of respective balance devices, i.e. when the piston rods 22a move toward the uppermost end (see the column on the left in FIG. 1**).

Generally, when the clutch 7 is actuated and the slide 12 repeats up and down motions, the piston rods 22a of the respective balance devices 22 are set to stay at the downmost position. Thus, the piston rods 22a and the slide 12 do not interfere with each other even if the slide 12 is moving up and down. As a result, the reciprocal motion of the slide 12 will not actuate the balance devices thereby preventing heat otherwise generated in the balance devices by the slide motions and a decrease in the durability.

On the other hand, when the compressed air supply from the fluid pressure source 23 is switched to the lower chambers of the respective balance devices 22 by switching the 4-port electromagnetic switch valve 24, the piston rods 22a of the respective balance devices 22 will move upward to engage the brackets 12a of the slide 12 upward from the underneath to support the load of the slide acting downwardly. When the motor 16 of the slide adjusting means 11 is driven, the worm wheels 14 are rotatingly displaced smoothly along the screw shaft 22 in the axial direction, and the position of the slide 12 can be easily adjusted.

Since the piston rods 22a of the respective balance devices 22 are separated from the slide 12 when the slide 12 is moving up and down, heat generation and decrease in durability can be prevented in this embodiment.

It is also noted that since the compressed air from the pressure source 23 is supplied to respective balance devices 22 via the 4-port electromagnetic switch valve 24 only when the die height clearance is to be adjusted, the load on the balance devices 22 becomes static. This leads to improved durability and safety as well as a simpler construction.

The weight of the slide 12 can also be reduced since it is not necessary to use a large sized motor 16 for the slide adjusting means 11.

Figure 2:
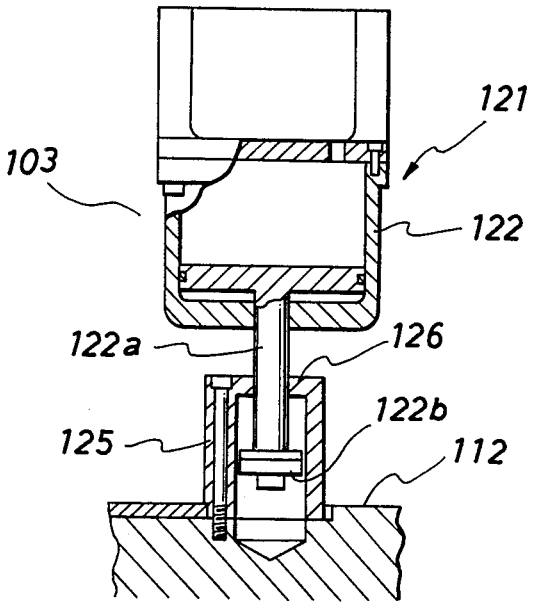
FIG. 2 is a sectional view of the cylinder mechanism which energizes the slide upward in a second embodiment of the present invention.

FIG. 2 shows the second embodiment of this invention in which a piston rod 122a of a balance device 122 is attached to the column 103 in a manner to face downward. A cylinder member 125 is provided on the upper portion of a slide 112. The piston rod 122a is inserted into the cylinder member 125 so that a flange 122b provided at the tip of the rod engages with the upper inside wall 126 of the cylinder member 125.

In this embodiment, when the compressed air is supplied to an upper chamber of the balance device 122, the flange 122b of the piston rod 122a reaches an intermediate position in the cylinder member 125 of the slide 122 so that the adjusting mechanism and the slide become disconnected.

On the other hand, when compressed air is supplied to the lower chamber of the balance device 122, it moves the piston rod 122a upward during the die height clearance adjustment, whereby the flange 122b engages with the upper inside wall 126 of the cylinder member 125 provided on the slide 112 to urge the slide upwardly along with the cylinder member 125.

What we claim is:

1. A balancing device for a press of the type in which a slide moves up and down with respect to a bolster during operation of the press and in which the position of the slide at the end of its downward movement with respect to the bolster is adjustable relative to the bolster to adjust a die height clearance of the press, said balancing device comprising an upward urging means mounted on said press and engagable with the slide, said upward urging means engaging the slide for urging the slide upwardly when the die height clearance is adjusted, said upward urging means being disengaged from the slide when the slide moves up and down with respect to the bolster during operation of the press.

2. A balancing device as claimed in claim 1 in which said upward urging means is a fluid piston-cylinder device.

3. A balancing device as claimed in claim 2 in which the piston-cylinder device has a cylinder, a piston slidable in the cylinder, and a piston rod on the piston projecting out of the cylinder for engaging a portion of the slide when the die height clearance is adjusted, the cylinder and piston being positioned for, when the piston rod engages with a portion of the slide for adjusting the die height clearance, the piston is intermediate the ends of the cylinder, whereby the piston can be moved toward one end of the cylinder to move the piston rod out of engagement with said portion of the slide to free the slide for movement without engaging the piston rod, and when the piston is moved toward the other end of said cylinder, the piston rod urges said slide upwardly.

4. A balancing device as claimed in claim 3 in which said cylinder is attached to said press below said slide with the piston rod extending upwardly and engaging a downwardly facing surface of said slide.

5. A balancing device as claimed in claim 3 in which said cylinder is attached to said press above said slide with the piston rod extending downwardly, and the end of said piston rod has a flange thereon, and said slide has a cylinder member on the upper portion thereof, said flange being movable to an intermediate position in said cylinder member when said piston is moved to the one end of the cylinder for being disengaged from the slide when the press is operating, and the flange is engaged with the upper inner end of said cylinder member when said piston is moved toward the other end of the cylinder for lifting said slide.

* * * * *